US009105237B2

(12) United States Patent
Choi

(10) Patent No.: US 9,105,237 B2
(45) Date of Patent: Aug. 11, 2015

(54) ORGANIC LIGHT EMITTING DISPLAY AND DRIVING METHOD THEREOF

(75) Inventor: Sangmoo Choi, Yongin-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 1547 days.

(21) Appl. No.: 12/081,891

(22) Filed: Apr. 23, 2008

(65) Prior Publication Data

US 2008/0266216 A1 Oct. 30, 2008

(30) Foreign Application Priority Data

Apr. 24, 2007 (KR) ..... 10-2007-0039965

(51) Int. Cl.
*G09G 3/30* (2006.01)
*G09G 3/32* (2006.01)

(52) U.S. Cl.
CPC ..... *G09G 3/3258* (2013.01); *G09G 2320/0233* (2013.01); *G09G 2320/0276* (2013.01); *G09G 2320/0285* (2013.01); *G09G 2320/041* (2013.01); *G09G 2320/043* (2013.01); *G09G 2320/048* (2013.01)

(58) Field of Classification Search
CPC ..... G09G 3/3233; G09G 3/3258; G09G 2320/0233; G09G 2320/0285; G09G 2320/043
USPC ..... 345/76–83; 315/169.3; 313/463, 504
See application file for complete search history.

(56) References Cited

U.S. PATENT DOCUMENTS

| | | | | |
|---|---|---|---|---|
| 6,414,664 | B1 | 7/2002 | Conover et al. | |
| 6,518,962 | B2 | 2/2003 | Kimura et al. | |
| 7,248,255 | B2 | 7/2007 | Yoshida | |
| 7,355,574 | B1 | 4/2008 | Leon et al. | |
| 7,859,501 | B2 * | 12/2010 | Levey et al. | 345/90 |
| 2003/0063081 | A1 | 4/2003 | Kimura et al. | |
| 2003/0160743 | A1 * | 8/2003 | Yasuda | 345/76 |
| 2004/0046757 | A1 | 3/2004 | Yamada | |
| 2004/0239661 | A1 | 12/2004 | Jo | |
| 2005/0110420 | A1 * | 5/2005 | Arnold et al. | 315/169.3 |
| 2005/0110786 | A1 | 5/2005 | Inoue et al. | |
| 2006/0001613 | A1 * | 1/2006 | Routley et al. | 345/76 |
| 2006/0238943 | A1 | 10/2006 | Awakura et al. | |
| 2006/0279490 | A1 * | 12/2006 | Park et al. | 345/76 |
| 2007/0008251 | A1 * | 1/2007 | Kohno et al. | 345/76 |

FOREIGN PATENT DOCUMENTS

| | | | |
|---|---|---|---|
| JP | 2002-311898 | | 10/2002 |
| JP | 2005-107059 | | 4/2005 |
| JP | 2005-352148 | A | 12/2005 |
| JP | 2006-251201 | A | 9/2006 |
| JP | 2006-251602 | A | 9/2006 |
| JP | 2007-017479 | A | 1/2007 |
| KR | 10-2000-0010923 | A | 2/2000 |
| KR | 10-2004-0074607 | A | 8/2004 |
| KR | 10-2006-0012986 | A | 2/2006 |
| WO | WO 2006/108277 | A1 | 10/2006 |

* cited by examiner

*Primary Examiner* — Jimmy H Nguyen
(74) *Attorney, Agent, or Firm* — Lee & Morse, P.C.

(57) ABSTRACT

An organic light emitting display including a plurality of pixel circuits and a data driver, the organic light emitting display including a power supplier electrically coupled to the organic light emitting display panel, a voltage detecting unit electrically coupled to the organic light emitting display panel and adapted to detect a voltage supplied from the power supplier, and a controller electrically coupled to the voltage detecting unit and adapted to output a control signal to at least one of the power supplier and the data driver based on the detected voltage.

20 Claims, 9 Drawing Sheets

ORGANIC LIGHT EMITTING DISPLAY AND DRIVING METHOD THEREOF

BACKGROUND OF THE INVENTION

1. Field of the Invention

Embodiments of the present invention relate to an organic light emitting display and a driving method thereof. More particularly, embodiments relate to an organic light emitting display and a driving method thereof that are capable of calibrating a brightness change due to a deterioration of an organic light emitting diode and/or a temperature change.

2. Description of the Related Art

An organic light emitting display is a display that emits light by electrically exciting a fluorescent or phosphorescent organic compound and can display an image by driving N×M organic light emitting diodes.

An organic light emitting diode generally includes an anode (ITO), an organic thin-film, and a cathode (metal). The organic thin-film may be formed in a multi-layered structure including a light emitting layer, an electron transport layer ETL and a hole transport layer HTL. The organic thin-film may include a separate electron injecting layer EIL and a hole injecting layer HIL.

In general, in such an organic light emitting diode OLED, a voltage applied to an anode electrode is set to be higher than a voltage applied to a cathode electrode. Thus, carriers having negative polarity may accumulate on the anode electrode, and carriers having positive polarity may accumulate on the cathode electrode. If the carriers of negative polarity positioned on the anode electrode and the carriers of positive polarity positioned on the cathode electrode are maintained for a long time, movement of electron(s) and hole(s) contributing to light emission may be reduced. Thus, an average brightness may be lowered, i.e., lowering of brightness due to deterioration.

In general, an organic light emitting diode has characteristics of diode. Like other diodes, a current flowing through the organic light emitting diode and a voltage thereof may increase as the temperature increases. So, brightness of the organic light emitting diode may increase as the temperature increases. Thus, brightness calibration may be necessary, e.g., to lower the brightness. In particular, for a digital driving method, i.e., driving by a fixed voltage, the influence of a change in temperature on the operation of the organic light emitting diode may be more pronounced than for other driving methods.

In general, in organic light emitting displays, when an organic light emitting diode deteriorates, there may be variations in current efficiency variation and/or current-voltage characteristics. In particular, displays using a digital driving method, i.e., a method of driving by a constant voltage, may be significantly impacted by a current-voltage characteristic variation. That is, e.g., for displays employing a digital driving method, an extent and impact of a current-voltage characteristic variation may be larger. Furthermore, problems may arise when organic light emitting diodes are to have the same brightness, i.e., when a light emission current value flowing through the organic light emitting diode varies depending on an ambient temperature change, and thus brightness thereof also varies.

A method of displaying a specific pattern on a screen, measuring a current value at that time, and comparing the measured current value with an actual current value may be employed to calibrate for such a brightness variation. An element for measuring a current may be attached to an organic light emitting display module so as to measure a current.

Accordingly, a cost and/or size of such an organic light emitting display may increase and/or it may not be possible to compare a current in real-time.

SUMMARY OF THE INVENTION

Embodiments of the present invention are therefore directed to an organic light emitting display and a driving method thereof, which substantially overcome one or more of the problems due to the limitations and disadvantages of the related art.

It is therefore a feature of an embodiment of the invention to provide an organic light emitting display that may calibrate a brightness change due to a deterioration of the organic light emitting diode and/or a temperature change in real-time while minimizing any increase in cost, i.e., minimizing any increase in cost of the organic light emitting display capable of calibrating a brightness change.

It is therefore a separate feature of an embodiment of the invention to provide a driving method for an organic light emitting display that may calibrate a brightness change due to a deterioration of the organic light emitting diode and/or a temperature change in real-time while minimizing any increase in cost, i.e., minimizing any increase in cost of the organic light emitting display capable of being driven so as to calibrate a brightness change.

It is therefore a separate feature of an embodiment of the invention to provide a driving method for an organic light emitting display that may calibrate a brightness change in real-time in accordance with a deterioration of the organic light emitting diode and/or a temperature change by measuring a current (voltage) flowing through the organic light emitting diode, comparing it with a reference value in a frame memory and calibrating a voltage of the power supplier and/or a data voltage of a data driver of the display.

At least one of the above and other features and advantages of the invention may be realized by providing an organic light emitting display including a data driver, the organic light emitting display including an organic light emitting panel including a plurality of pixel circuits, the organic light emitting display including a power supplier electrically coupled to the organic light emitting display panel, a voltage detecting unit electrically coupled to the organic light emitting display panel and adapted to detect a voltage supplied from the power supplier, and a controller electrically coupled to the voltage detecting unit and adapted to output a control signal to at least one of the power supplier and the data driver based on the detected voltage.

The controller may be adapted to at least one of reduce a voltage value of the power supplier and decrease a brightness of the pixel circuits when the detected voltage value is larger than a voltage value calculated in the controller and to at least one of increase a voltage value of the power supplier and increase the brightness of the pixel circuits when the detected voltage value is smaller than a voltage value calculated in the controller.

The voltage detecting unit may be electrically coupled between the power supplier and the pixel circuits of the organic light emitting display panel.

The voltage detecting unit may be coupled between the power supplier and all pixel circuits.

The voltage detecting unit may be coupled between the power supplier and at least one pixel circuit.

The voltage detecting unit may be coupled between the power supplier and the pixel circuits by a resistor and measures a voltage applied to the resistor.

The controller may include an accumulative addition unit adapted to measure a voltage value by accumulating a voltage value applied to the pixel circuits, a frame memory that is electrically coupled to the organic light emitting display panel and stores a reference value for a data value applied to the pixel circuits, and a comparison unit that is electrically coupled to the accumulative addition unit and the frame memory and compares the reference value with the measured voltage value calculated in the accumulative addition unit.

The controller may include a voltage adjusting unit that is electrically coupled to the comparison unit and adjusts a voltage value of the power supplier in accordance with a result of the comparison unit.

The accumulative addition unit may accumulate a voltage value applied to the pixel circuits for each period of at least one frame.

The frame memory may store a lookup table of the reference value for the accumulated data value and may transfer the reference value for the data to the comparison unit.

The frame memory may be one of a PROM, an EPROM, an EEPROM, and a flash memory.

The comparison unit may transfer a difference between the reference value and the detected voltage value to the voltage adjusting unit.

The voltage adjusting unit may increase a voltage of the power supplier as much as a difference between the reference value and the detected voltage value.

The controller may include a gamma adjusting unit that is electrically coupled to the comparison unit and adjusts a data value of the data driver in accordance with a result of the comparison unit.

The accumulative addition unit may be electrically coupled to the voltage detecting unit.

The voltage detecting unit may be coupled between the power supplier and only some of the pixel circuits.

At least one of the above and other features and advantages of the invention may be separately realized by providing a driving method of an organic light emitting display including a data driver, the organic light emitting display a data driver, the organic light emitting display including an organic light emitting panel including a plurality of pixel circuits, the method including supplying power to the organic light emitting display panel by a power supplier, detecting a voltage supplied from the power supplier to the organic light emitting display panel by a voltage detecting unit, and controlling at least one of the power supplier and the data driver based on the detected voltage value, the controller being electrically coupled to the voltage detecting unit.

Controlling may include decreasing a voltage value of the power supplier when a voltage value detected in the voltage detecting unit is larger than a voltage value calculated in the controller and increasing a voltage value of the power supplier when a voltage value detected in the voltage detecting unit is smaller than a voltage value calculated in the controller.

Controlling may include outputting a control signal for decreasing a brightness of the pixel circuits when a voltage value detected in the voltage detecting unit is larger than a voltage value calculated in the controller and outputting a control signal for increasing a brightness of the pixel circuits when a voltage value detected in the voltage detecting unit is smaller than a voltage value calculated in the controller.

The voltage detecting unit may be electrically coupled between the power supplier and the pixel circuits of the organic light emitting display panel.

The voltage detecting unit may be coupled to the power supplier and all pixel circuits of the organic light emitting display and detecting comprises detecting a voltage of all the pixel circuits.

The voltage detecting unit is coupled between the power supplier and at least one pixel circuit.

The voltage detecting unit may be coupled between the power supplier and only some of the pixel circuits.

The voltage detecting unit may be coupled between the power supplier and the pixel circuits by a resistor and measures a voltage applied to the resistor.

Controlling may include determining a detected voltage value by accumulating a voltage value applied to the pixel circuits, storing a reference value for a data value applied to the pixel circuits, and comparing the reference value with the detected voltage value.

Controlling may include adjusting a voltage value of the power supplier in accordance with a result of comparing.

Adjusting the voltage value may include increasing/decreasing a voltage of the power supplier by up to a difference between the reference value and the detected voltage value.

Controlling may include adjusting a data value of the data driver in accordance with a result of comparing.

Adjusting the data value may include increasing/decreasing a data voltage of the data driver in proportion to a difference between the reference value and the detected voltage value.

BRIEF DESCRIPTION OF THE DRAWINGS

The above and other features and advantages will become more apparent to those of ordinary skill in the art by describing in detail exemplary embodiments thereof with reference to the attached drawings, in which.

DETAILED DESCRIPTION OF THE INVENTION

Figure 1:
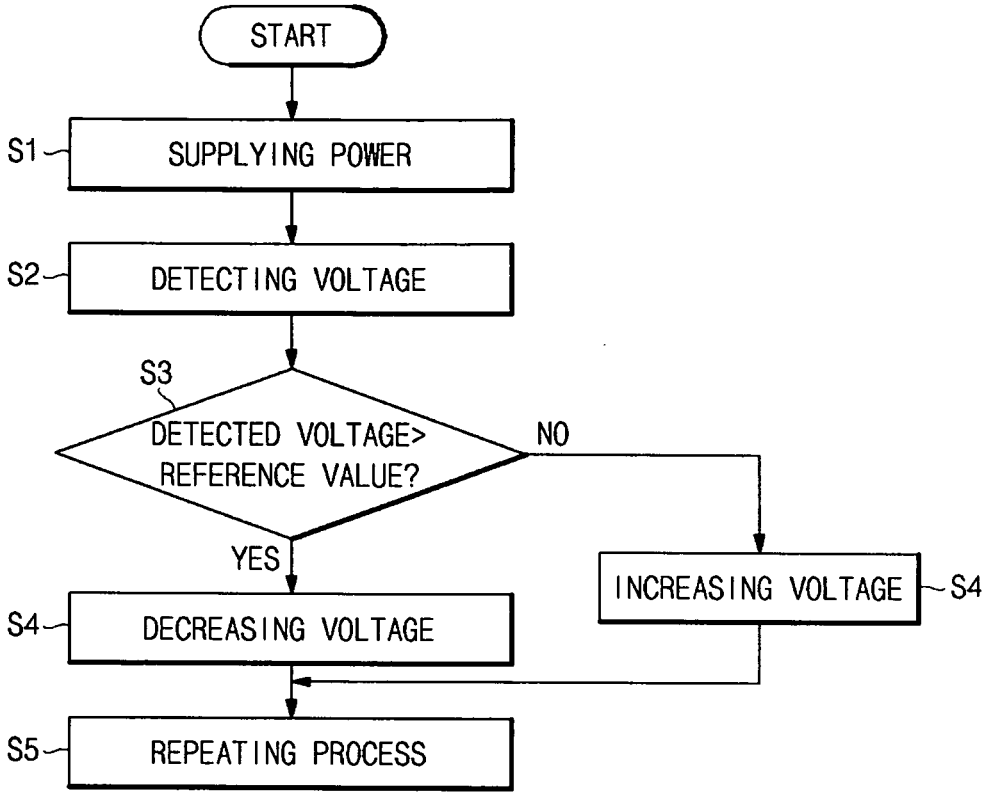
FIG. 1 illustrates a flow chart of a driving method of an organic light emitting display according to an exemplary embodiment of the present invention.

Korean Patent Application No. 10-2007-0039965 filed on Apr. 24, 2007, in the Korean Intellectual Property Office, and entitled: "Organic Light Emitting Display and Driving Method Thereof," is incorporated by reference herein in its entirety.

Embodiments of the present invention will now be described more fully hereinafter with reference to the accompanying drawings, in which exemplary embodiments of the invention are illustrated. Aspects of the invention may, however, be embodied in different forms and should not be construed as limited to the embodiments set forth herein. Rather, these embodiments are provided so that this disclosure will be thorough and complete, and will fully convey the scope of the invention to those skilled in the art. In the following description, it is understood that when an element is referred to as being "between" a first element and a second element, the element may be directly between the first and second elements or via one more other intervening elements. It is also understood that when an element is referred to as being "coupled to" another element, unless specified otherwise, the element may be directly coupled to the another element, or via one or more other intervening elements. Like reference numerals refer to like elements throughout the specification.

Hereinafter, an exemplary method for brightness calibration of an organic light emitting display according to an exemplary embodiment of the present invention will be described.

Figure 2:
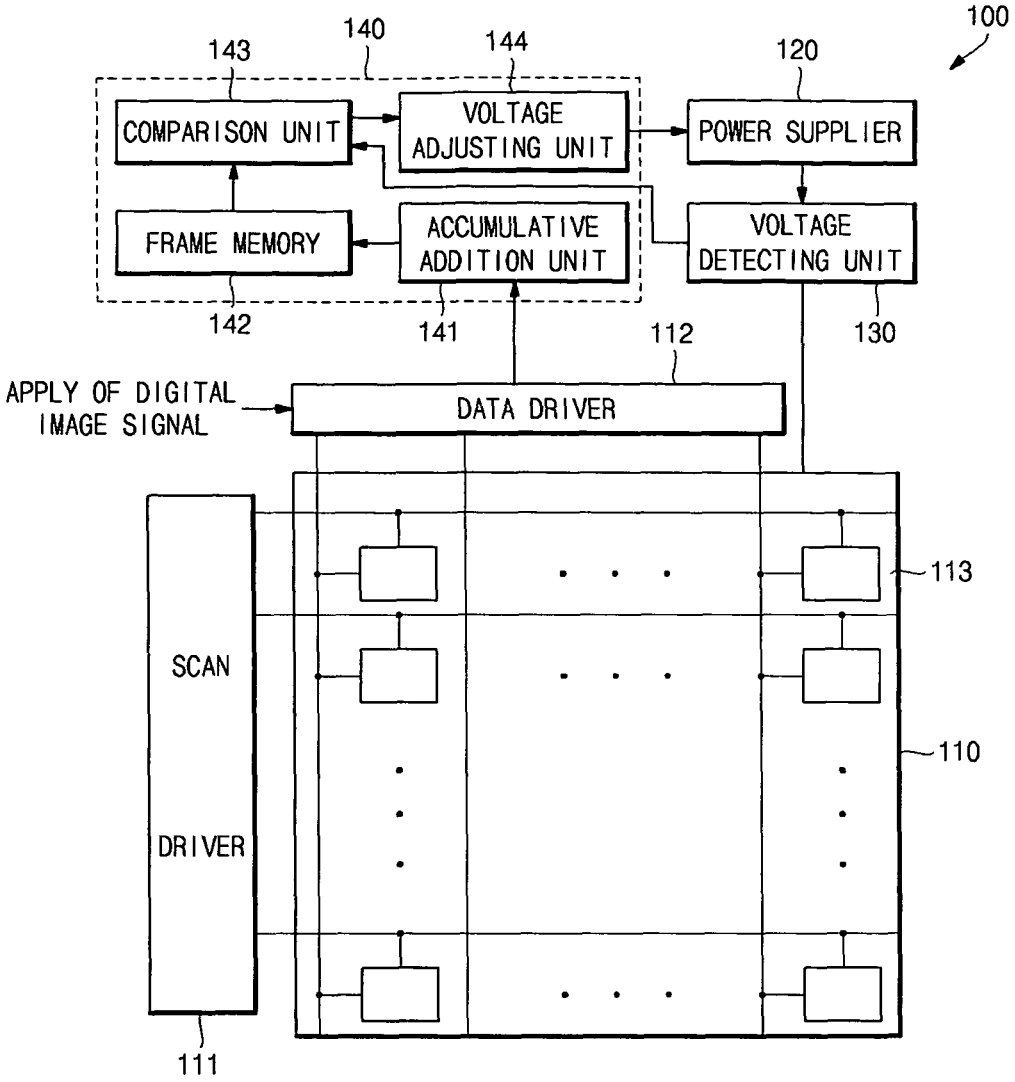
FIG. 2 illustrates a schematic block diagram of an organic light emitting display according to an exemplary embodiment of the present invention.

FIG. 1 illustrates a flow chart of a driving method of an organic light emitting display according to an exemplary embodiment of the present invention. FIG. 2 illustrates a schematic block diagram of an organic light emitting display 100 according to an exemplary embodiment of the present invention.

As illustrated in FIG. 1, a brightness calibration method of an organic light emitting display according to an embodiment of the present invention may include a supplying power operation S1, a detecting voltage operation S2, a detected voltage to a reference value comparison operation S3, an increasing/decreasing a power source voltage operation S4, and a repeating operation S5.

Referring to FIG. 2, the organic light emitting display 100 according to an exemplary embodiment of the present invention may include an organic light emitting display panel 110, a power supplier 120, a voltage detecting unit 130 and a controller 140. The organic light emitting display panel 110 may include a scan driver 111, a data driver 112 and pixel circuits 113. An exemplary method of driving the organic light emitting display 100 of FIG. 2 according to the first exemplary embodiment illustrated in FIG. 1 will be described below.

For the supplying power operation S1, the power supplier 120 may supply power to the organic light emitting display panel 110. The power supplier 120 may supply a constant and/or substantially constant voltage to the scan driver 111, the data driver 112, and/or the pixel circuit(s) 113.

For the detecting voltage operation S2, a voltage value of a predetermined portion of the organic light emitting display panel 110 may be measured. Based on the voltage detected from the detecting voltage operation S2, a voltage value for obtaining a constant and/or substantially constant brightness of the pixel circuit 113 may be obtained. Using the obtained voltage value, a value of current flowing through a light emitting pixel of the organic light emitting display panel 110 may be determined.

For the comparison operation S3, the detected voltage may be compared with a reference value. From a result of the comparison operation S3, an extent of deterioration of a pixel circuit and/or an extent of influence of temperature change(s) may be determined.

Then, based on the result of the comparison operation S3, a power source voltage may be altered by the increasing or decreasing voltage operation S4. More particularly, in some embodiments, e.g., the power source voltage may be increased/decreased based on the result of the comparison operation S3 in order to calibrate a brightness change based on an amount of deterioration of the respective pixel circuit and/or an amount of change in temperature, e.g., an amount of change in ambient temperature.

In some embodiments, in order to calibrate brightness of a currently-emitting one of the light emitting pixel(s) in real time, the supplying power operation S1, the detecting voltage operation S2, the comparison operation S3, and/or the increasing/decreasing voltage operation S4 may be repeated one or more times by the repeating operation S5.

Embodiments of the exemplary brightness calibrating method described above may enable pixel brightness to be substantially and/or completely controlled so as to be substantially and/or completely indifferent to deterioration of the pixel circuit 113 and/or changes in temperature, e.g., changes in ambient temperature. Further, because embodiments of the exemplary brightness calibrating method described above may be implemented on a pixel currently emitting light, i.e., a currently-emitting one of the light emitting pixel circuit(s) 113, brightness calibration may be carried out in real-time.

Figure 3:
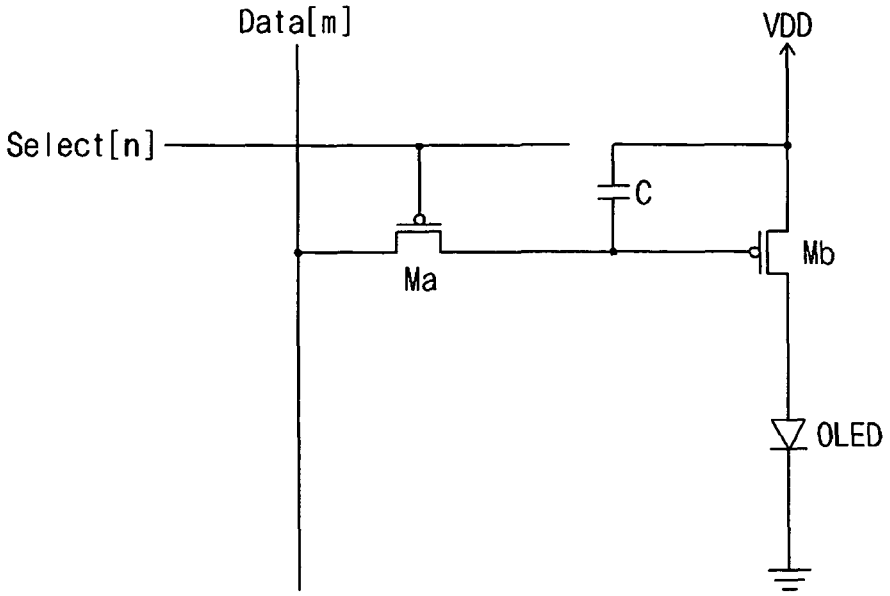
FIG. 3 illustrates a circuit diagram of a pixel circuit of a general organic light emitting display.
Figure 4:
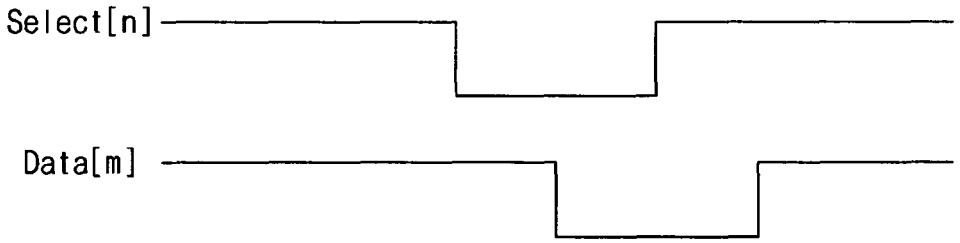
FIG. 4 illustrates a timing diagram of exemplary signals employable for driving the pixel circuit of FIG. 3.

FIG. 3 illustrates a circuit diagram of an exemplary embodiment of the pixel circuit 113 of the organic light emitting display 100. FIG. 4 illustrates a timing diagram of exemplary signals employable for driving the pixel circuit 113 of FIG. 3.

Referring to FIG. 3, the pixel circuit 113 may include a switching transistor Ma, a driving transistor Mb, a capacitor C and an organic light emitting diode OLED. A gate of the switching transistor Ma may be coupled to a respective scan line Select[n] of the display panel 110. A gate of the driving transistor Mb may be coupled to a respective data line Data [m] of the display panel 110. A first terminal of the switching transistor Ma may be coupled to the respective data line Data[m]. A first terminal of the capacitor C may be coupled to a first terminal of the driving transistor Mb. A second terminal of the capacitor C may be coupled to the gate of the driving transistor Mb and a second terminal of the switching transistor Ma. A second terminal of the driving transistor Mb may be coupled to a first terminal of the organic light emitting diode OLED.

Referring again to FIG. 2, the scan driver 111 may apply a voltage to a row of the pixel circuits 113. Selected one(s) of the pixel circuits 113 may emit light based, e.g., on a combination of the scan voltage(s) and the data voltage(s) applied thereto. More particularly, the scan driver 111 may respectively apply a voltage to scan lines of the display panel 110. The switching transistor Ma of the pixel circuits 113 coupled to the currently driven scan line, i.e., scan line to which a voltage is currently applied, may be turned on. Based on a value of respective data supplied to the data line Data[m] associated with the pixel circuit 113 when the switching transistor Ma thereof is turned on, the corresponding pixel circuit 113 may emit light.

That is, the data driver 112 may apply a data voltage value to the pixel circuits 113 that are selected by the scan driver 111 via the respective scan line Scan[n]. The data driver 112 may be electrically coupled to a gate of the driving transistor Mb of each of the pixel circuits 113 via the respective data line. Hence, a gate voltage of the driving transistor Mb may vary depending on a respective data voltage value supplied from the data driver 112. In the following description, while reference may be made to a single pixel circuit 113, features described therewith may correspond to one, some or all of the pixel circuit(s) 113.

More particularly, a current flowing through the organic light emitting diode OLED of the pixel circuit 113 may be in accordance with the following equation.

$$I_{OLED} = \frac{1}{2}\beta(V_{GS} - V_{TH})^2$$

In the foregoing equation, $V_{GS}$ denotes a voltage difference between a control electrode (gate electrode) of the driving transistor Mb and the first electrode (source or drain electrode) thereof, and $V_{TH}$ denotes a threshold voltage of the driving transistor Mb. Furthermore, β is a constant corresponding to a value produced by multiplying a mobility of an electron or a hole by a capacitance of silicon oxide, and $I_{OLED}$ corresponds to a value of current flowing through an organic light emitting diode. By controlling current flow through the organic light emitting diode OLED, an amount of coupling of electron(s) with hole(s) in an emission layer of the organic light emitting diode OLED may be varied. Thus, brightness of the organic light emitting diode OLED may be controlled.

Embodiments of the invention may employ a digital driving method. A digital driving method may include applying data in the form of a digital signal representing a binary number rather than an analog signal. In such cases, the organic light emitting diode OLED may be turned on and off based on the digital signal, and brightness adjustments may be made based on a turn-on time per each frame. In the digital driving method, a gate voltage of the driving transistor Mb may be set to 0 or 1 (actual applied voltage may be set differently depending on the case), and a source voltage may be set to $V_{DD}$. Hence, if data is applied in the form of a digital signal, it may be possible to calculate values of $V_{GS}$ and $V_{TH}$ in the above equation upon turning on and off. Thus, an amount of current flowing through the organic light emitting diode OLED may be obtained, by experiment, for each data value.

Referring again to FIGS. 2 and 3, in case of an active matrix (AM) driving method, the pixel circuit 113 may be coupled between the power supplier 120 (VDD) and ground. More particularly, in embodiments in which a drain (second terminal) of the switching capacitor Ma is coupled to a gate of the driving transistor Mb, when the switching transistor Ma is turned on by the scan driver 111, then a data voltage may be applied to the gate of the driving transistor Mb.

Further, if a data voltage is applied to the gate of the driving transistor Mb, then a current may flow due to a voltage difference between a data value and the power supplier 120 (VDD) by the aforementioned equation.

$$I_{OLED} = \frac{1}{2}\beta(V_{GS} - V_{TH})^2$$

In the digital driving method, since a voltage of the data driver 112 may be fixed to about or exactly 0 or 1 (actual applied voltage may be set differently depending on the case), a current value per each data value may be fixed at a constant and/or substantially constant amount. Hence, in order to represent different brightness levels, the digital driving method may not vary a current value, but may control a light emission time of the respective organic light emitting diode OLED.

Referring to FIG. 3, in the exemplary embodiment illustrated therein, the switching transistor Ma and the driving transistor Mb are both illustrated as p-type transistors, and in the description below, it will be assumed that the switching transistor Ma and the driving transistor Mb are p-type transistors. However, embodiments of the invention are not limited thereto.

Referring to FIG. 4, in embodiments in which the gate electrode of the switching transistor Ma is electrically coupled to the scan driver 111, when a signal of the scan driver 111 has a low value, the switching transistor Ma may be turned on. When turned on, the switching transistor Ma may transfer a data value from the data driver 112 to the driving transistor Mb. When a data value of the data driver 112 is low, then the driving transistor Mb may be turned on. When the driving transistor Mb is turned on, a forward bias may be applied to the organic light emitting diode OLED, so that the organic light emitting diode OLED may emit light.

Referring to FIG. 3, the capacitor C may enable the gate electrode and the first electrode of the driving transistor Mb to maintain a constant and/or substantially constant voltage. Hence, in the digital driving method, a current value flowing through the organic light emitting diode OLED may be maintained constant and/or substantially constant, and brightness of the organic light emitting diode OLED may be maintained constant and/or substantially constant.

Referring again to FIG. 2, a more detailed description of the exemplary embodiments of the organic light emitting display 100 will be provided below. In some embodiments, as described above, the power supplier 120 may be electrically coupled to the scan driver 111, the data driver 112, and the pixel circuit 113, and may supply a voltage to them. Furthermore, because a current value flowing through the organic light emitting diode OLED may be determined by the power source voltage as described above, the further description thereabout will be omitted.

As shown in FIG. 2, the voltage detecting unit 130 may be electrically coupled between the organic light emitting display panel 110 and the power supplier 120. More specifically, in some embodiments, e.g., the voltage detecting unit 130 may include a resistor (not shown) that is coupled in series to the wiring between the power supplier 120 to the organic light emitting display panel 110. In some embodiments, the resistor may have a relatively low resistance value so as to exert a minimal/slight influence on the driving operation of the organic light emitting display panel 110. More particularly, e.g., in some embodiments, the resistor of the voltage detecting unit 130 may have a unit of several tens to hundreds ohms.

In such embodiments in which the voltage detecting unit 130 includes a resistor, the voltage detecting unit 130 may measure a voltage at both ends of the resistor. In such embodiments, if the voltage across the resistor is measured, it may be possible to calculate a value of current flowing through the organic light emitting diode OLED because a resistance value of the resistor may be known. Thus, in such embodiments, the voltage across the resistor may be detected by the voltage detecting unit 130 in order to determine a value of current flowing through the organic light emitting diode OLED. The determined current value may be employed to determine an extent of brightness relative to an amount of deterioration of the organic light emitting diode OLED and/or an amount of change in temperature, e.g., ambient temperature.

Referring to FIG. 2, the controller 140 may be electrically coupled to the data driver 112, the power supplier 120, and the voltage detecting unit 130. The controller 140 may increase or decrease a voltage of the power supplier 120 based on an amount of change in brightness of the organic light emitting diode OLED, e.g., extend of change in brightness due to, e.g., deterioration of the organic light emitting diode OLED and/or change in temperature. The controller 140 may include an accumulative addition unit 141, a frame memory 142, a comparison unit 143, and a voltage adjusting unit 144.

The accumulative addition unit 141 may be electrically coupled to the data driver 112, as illustrated in FIG. 2. The accumulative addition unit 141 may accumulate data value(s) applied from the data driver 112. In case of the digital driving method, because a data applied by the data driver 112 may be represented by 0 or 1, by accumulating the data, it may be possible to know a number of pixels of the organic light emitting diode display panel 110 that emit light at a respective period of time.

The frame memory 142 may be electrically coupled to the accumulative addition unit 141. The frame memory 142 may receive the accumulated data value from the accumulative addition unit 141 and may output a reference value, e.g., a reference voltage value, which may serve as a point of reference to an extent of a brightness change of the organic light emitting diode OLED. A lookup table for determining the reference value to be output may be stored in the frame memory 142.

Figure 5:
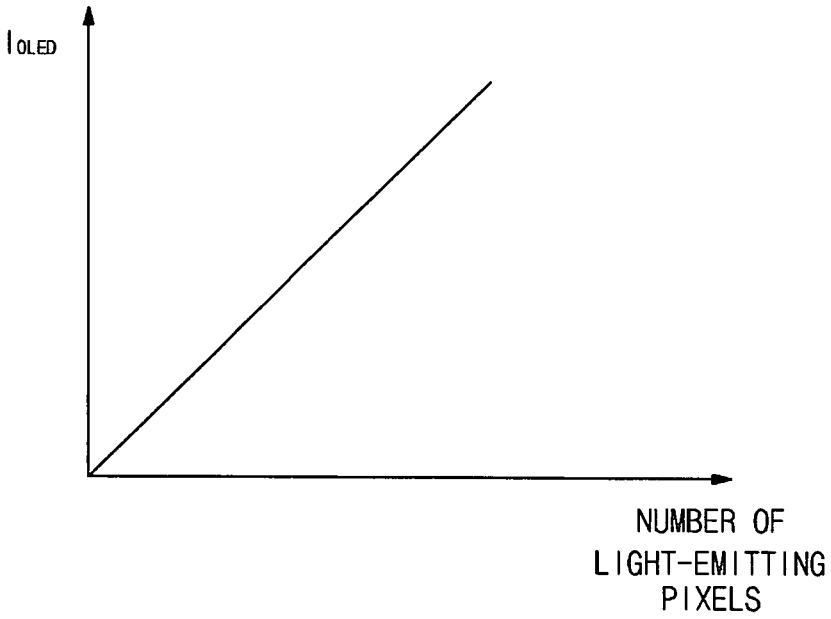
FIG. 5 illustrates a graph of a pattern of a lookup table for calculating a reference value of a voltage value in an organic light emitting display according to an exemplary embodiment of the present invention.

FIG. 5 illustrates a graph of a pattern of an exemplary lookup table for determining the reference voltage value in an organic light emitting display 100 according to an exemplary embodiment of the present invention. More particularly, e.g., in some embodiments, values corresponding to the lookup table pattern of FIG. 5 may be stored in the frame memory 142. Referring to FIG. 5, the horizontal axis corresponds to a number of light-emitting pixels, and the vertical axis corresponds to a current value applied to the organic light emitting display panel 110.

As described above, a digital driving method may enable a brightness of an organic light emitting display to be controlled based on an amount of time during which a current flow through each respective organic light emitting diode OLED of the display. That is, according to the digital driving method, a brightness of an organic light emitting display need not be controlled based on a value of current flowing through each of the respective organic light emitting diodes OLEDs. Hence, a value $I_{OLED}$ of current flowing through respective ones of organic light emitting diodes OLEDs of the display 100 at a point in time may be proportional to a number of those pixels that emit light at that point in time.

The exemplary pattern of FIG. 5 illustrates a proportional relationship between the number of light-emitting pixels and a value $I_{OLED}$ of current flowing through the respective organic light emitting diodes OLEDs. A definite value of the graph or the lookup table of FIG. 5 may be a value based on various factors, e.g., a material used for the organic light emitting diode OLED, a voltage value supplied from the power supplier 110, and a threshold voltage value $V_{TH}$ of the driving transistor Mb of the pixel circuit 113. Those skilled in the art can easily obtain a data value of the corresponding lookup table with reference to embodiments of the present invention. Accordingly, further description thereof will be omitted.

The frame memory 142 may be, e.g., a PROM (programmable read only memory) that is programmable only once, an EPROM (erasable PROM) that is reprogrammable, an EEPROM (electrically erasable PROM) that is electrically reprogrammable, and a flash memory.

More specifically, because, in many cases, characteristic(s) of the manufactured organic light emitting display panel 110 may be influenced by even a small variation of a process condition, each organic light emitting display panel 110 may have a different brightness characteristic. Hence, in case that a memory, which is not programmable, such as a mask ROM (mask read only memory) is used, a fixed power calibration value may be used for all manufactured organic light emitting display panels 110. In such cases, it may not be possible to carry out an appropriate power calibration. Accordingly, by recording a power calibration value appropriate for the respective manufactured organic light emitting display panel 110 using a programmable memory, it may be possible to obtain an organic light emitting display having a desired brightness characteristic in spite of a variation of a process condition(s). Hence, in some embodiments, the frame memory 142 may be a PROM, an EPROM, an EEPROM, and a flash memory that are programmable, but not limited thereto.

As illustrated in FIG. 2, the comparison unit 143 may be electrically coupled to the voltage detecting unit 130 and the frame memory 143. The comparison unit 143 may compare a voltage value detected by the voltage detecting unit 130 and a reference value output from the frame memory 142, and may output a difference between the reference value and the measured voltage value.

The voltage adjusting unit 144 may be electrically coupled to the comparison unit 143. The voltage adjusting unit 144 may receive an output of the comparison unit 143, e.g., a result of a comparison, as an input.

In some embodiments, when a difference between the reference value and the measured voltage value is positive, i.e., the reference value is larger than the measured voltage value, then the comparison unit 143 may increase a voltage of the power supplier 120 as much as the difference between the reference value and the measured voltage value.

In some embodiments, when a difference between the reference value and the measured voltage value is negative, i.e., the reference value is smaller than the measured voltage value, then the comparison unit 143 may decrease a voltage of the power supplier 120 as much as the difference between the reference value and the measured voltage value. As a result, in such cases and under such conditions, the comparison unit 143 may reduce a voltage of the power supplier 120.

Such a difference between the reference value and the measured voltage value may result from, e.g., a deterioration of the organic light emitting diode OLED and/or a variation of a current-voltage characteristic due to a temperature change. Hence, by calibrating a voltage of the power supplier 120 by the voltage adjusting unit 143, some embodiments of the invention may enable a brightness of the display to be calibrated substantially and/or completely irrespective of deterioration and/or a temperature change.

As described above, an organic light emitting display according to an embodiment of the present invention may calibrate brightness in real-time substantially and/or completely irrespective of a deterioration of the organic light emitting diode OLED and/or a temperature change. More particularly, as described above, an organic light emitting display according to an embodiment of the present invention may calibrate brightness in real-time for all cases substantially and/or completely irrespective of a deterioration of the organic light emitting diode OLED and/or a temperature change.

In some embodiments, the voltage detecting unit 130 may be arranged in a same module as the display 100. In such embodiments, e.g., a separate element for measuring a current may not be required, so a unit cost may be lowered.

Figure 6:
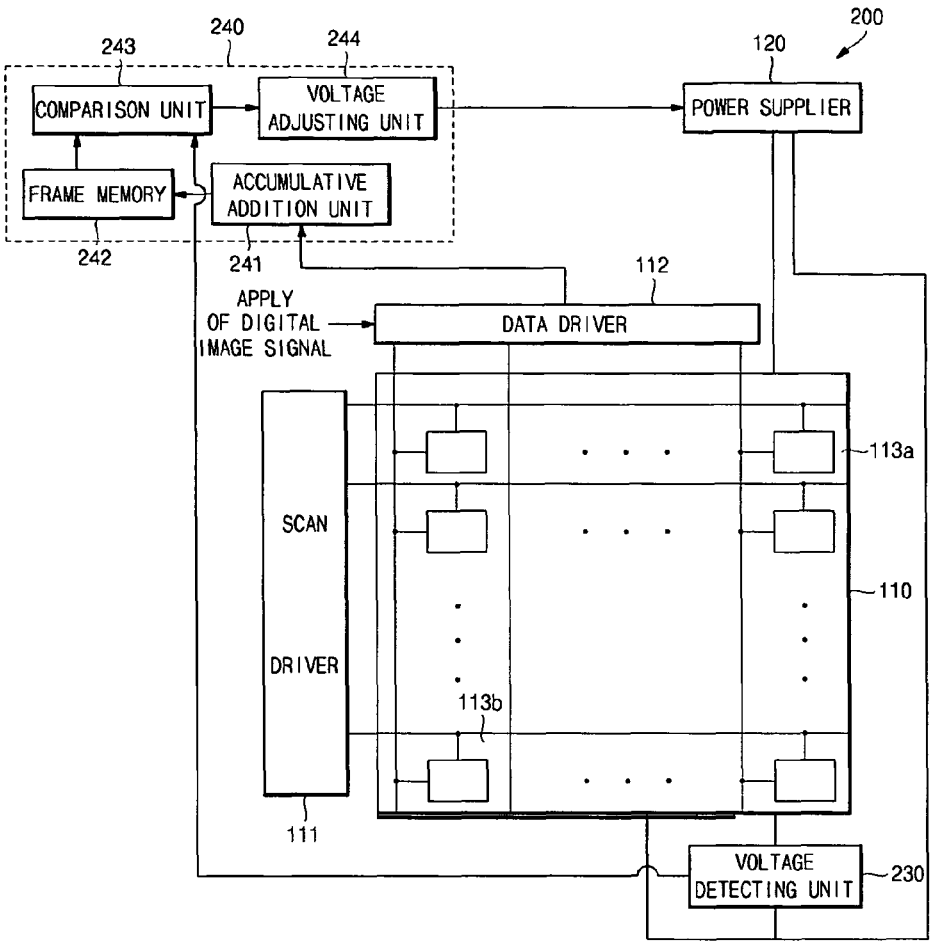
FIG. 6 illustrates a schematic block diagram of an organic light emitting display according to another exemplary embodiment of the present invention.

FIG. 6 illustrates a schematic block diagram of an organic light emitting display 200 according to another exemplary embodiment of the present invention.

As illustrated in FIG. 6, the organic light emitting display 200 according to another embodiment of the present invention may include, in addition to the organic light emitting display panel 110 and the power supplier 120, a voltage detecting unit 230 that is electrically coupled to a portion of the organic light emitting display panel 110 and a controller 240 that is electrically coupled to the voltage detecting unit 230.

As illustrated in FIG. 6, the organic light emitting display 200 may substantially correspond to the organic light emitting display 100 of FIG. 2. Components having the same constitution and operation are denoted by the same reference numeral. In general, only differences between the organic light emitting display 200 and the organic light emitting display 100 will be described below.

As illustrated in FIG. 6, the voltage detecting unit 230 may be electrically coupled between a portion of the organic light emitting display panel 110 and the power supplier 120. In some embodiments, the voltage detecting unit 230 may only be coupled to a portion (in FIG. 6, one column in the vertical direction) of the organic light emitting display panel 110. For example, organic light emitting display panel 110 may include pixel circuit(s) 113*a* to which the voltage detecting unit 230 may be coupled and pixel circuit(s) 113*b* to which the voltage detecting unit 230 is not coupled. The pixel circuit(s) 113*a* and the pixel circuit(s) 113*b* may be coupled to the power supplier 120 through different wirings.

The voltage detecting unit 230 may include a resistor (not shown) similar to the voltage detecting unit 130 of the exemplary display 100. In some embodiments, the resistor may have a small resistance value so as to exert a slight and/or minimal influence on the driving operation of the display 200. For example, the resistor may a resistance of, e.g., several tens to hundreds of ohms.

The function of the voltage detecting unit 230 may be the same as that of the voltage detecting unit 130 in the exemplary display 100, and thus further description thereabout will be omitted.

The controller 240 may include an accumulative addition unit 241, a frame memory 242, a comparison unit 243, and a voltage adjusting unit 244.

The accumulative addition unit 241 may receive only a data value applied to the pixel circuit(s) 113*a* to which the voltage detecting unit 230 is coupled from the data driver 112. Differently from the exemplary display 100, the accumulative addition unit 241 may not receive a data value of all pixel circuits 113, but rather only a data value of the pixel circuit(s) 113*a* to which the voltage detecting unit 230 is coupled. The accumulative addition unit 241 may accumulate only a data value of the pixel circuit(s) 113*a* to which the voltage detecting unit 230 is coupled, and may outputs the same.

The frame memory 242 may be electrically coupled to the accumulative addition unit 241. The frame memory 242 may receive an output of the accumulative addition unit 241 as an input. The frame memory 242 may calculate a value of current flowing through a light-emitting pixel circuit, that is, a reference value. Hence, the frame memory 242 may store a lookup table for calculating the reference value. In some embodiments, the lookup table may be the lookup table 100 of FIG. 5.

The function of the frame memory 242 may be the same as that of the frame memory 142 of the exemplary display 100, and thus further description thereof may not be repeated.

The comparison unit 243 may be electrically coupled to the voltage detecting unit 230 and the frame memory 242. The comparison unit 243 may compare a voltage value measured in the voltage detecting unit 230 with a reference value calculated in the frame memory 243, and may output a difference between the reference value and the measured voltage value.

The voltage adjusting unit 244 may be electrically coupled to the comparison unit 243. Like the voltage adjusting unit 144 of the exemplary display 100 described above, the voltage adjusting unit 244 may compare the reference value applied to the voltage adjusting unit 244 with the measured voltage value, and may calibrate the voltage value of the power supplier 120.

Although not illustrated in the drawing, the voltage detecting unit 230 may be coupled, e.g., to pixel circuit(s) 113*a* of a single row, e.g., one of the n rows extending along a horizontal axis, to pixel circuits 113*a* of a single column, e.g., one of the m columns extending along a vertical axis, or simply one or some of the pixel circuits 113*a*. That is, e.g., the voltage detecting unit 230 may be coupled to pixel circuits 113*a* occupying a space of the organic light emitting display panel 110 in the form of a polygon. Referring to FIG. 6, since such a coupling may be easily conceived by those skilled in the art, further description about the coupling of the pixel circuit 113*a* may not be repeated.

In the organic light emitting display 200 according to another embodiment of the present invention, the voltage detecting unit 230 may be coupled only to one or some of the pixel circuit(s) 113*a* of the organic light emitting display panel 110. The voltage detecting unit 230 may measure a voltage of the pixel circuit(s) 113*a* to which it is coupled. The comparison unit 240 may compare the reference voltage with only a data value corresponding to the pixel circuit(s) 113*a*.

In embodiments in which only a value of the partial pixel circuit(s) 113*a* is employed for measuring and comparing, then the accumulative addition unit 241 may not accumulate data from all pixel circuits of the display, but may only accumulate partial data, i.e., only data corresponding to the pixel circuit(s) 113*a*. Such embodiments may be advantageous because a speed of calculation may become faster.

Hereinafter, a brightness calibration method for an organic light emitting display 300 according to yet another embodiment of the present invention will be described.

Figure 7:
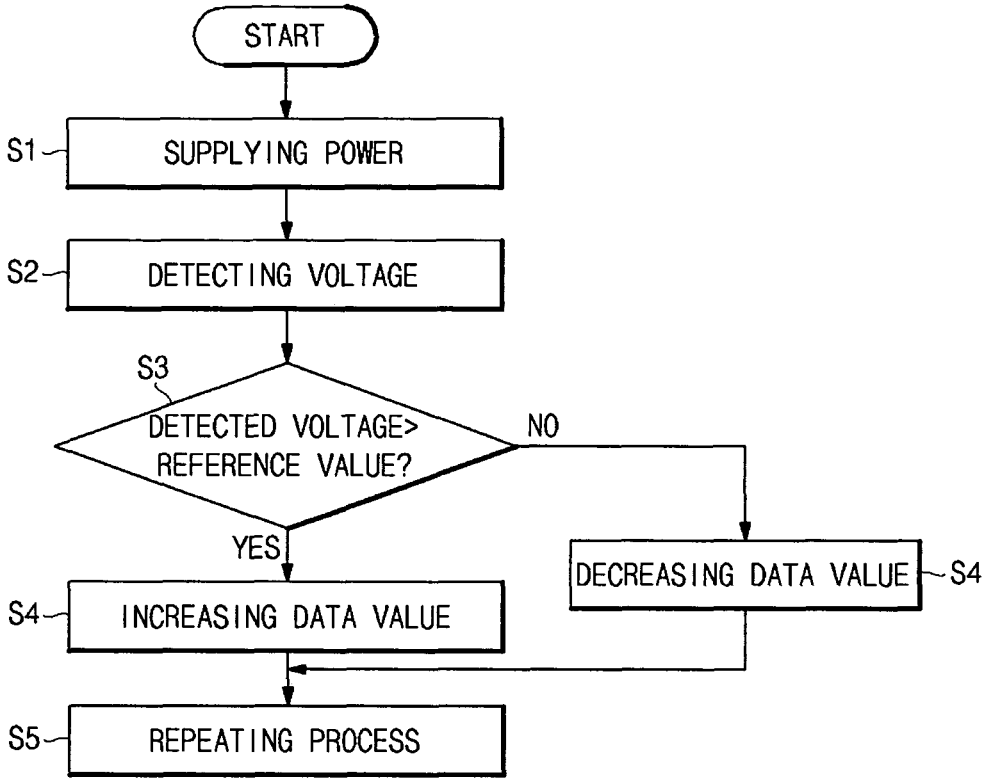
FIG. 7 illustrates a flow chart of a driving method of an organic light emitting display according to yet another exemplary embodiment of the present invention.

FIG. 7 illustrates a flow chart of a driving method of an organic light emitting display according to yet another exemplary embodiment of the present invention.

As illustrated in FIG. 7, a brightness calibration method according to another embodiment of the present invention may include a supplying power operation S1, a detecting voltage operation S2, a detected voltage to a reference value comparison operation S3, an increasing/decreasing data value operation S4, and a repeating operation S5.

The brightness calibration method of FIG. 7 substantially corresponds to the exemplary brightness calibration method of FIG. 1. Accordingly, in general, only differences between the exemplary methods of FIGS. 1 and 7 will be described below.

Similar to the power supplying operation S1 of FIG. 1, the power supplying operation S1 may include supplying power to from a power source to an organic light emitting display panel, and may be carried out by a power supplier. The power supplier may serve to supply a constant voltage to a scan driver and a data driver, as well as to a pixel circuit.

Similar to the detecting voltage operation S2 of FIG. 1, the detecting voltage operation S2 may include measuring a voltage value of a portion of an organic light emitting display panel. Using the voltage detected in the detecting voltage operation S2, a voltage value for obtaining a constant brightness of pixel circuit(s) may be obtained. Using such a voltage value, a value of current flowing through a light-emitting pixel may be calculated.

Similar to the comparison operation S3 of FIG. 1, the comparison operation S3, may compare the detected voltage with a reference value. By comparing the detected voltage with a reference value, extent of deterioration of a pixel circuit and/or an extent of influence of temperature may be determined.

The increasing/decreasing operation S4 may include calibrating a brightness change in accordance with deterioration and/or temperature change by increasing or decreasing a voltage value of a data driver with a value obtained from the comparison operation S3.

As discussed above, when employing a digital driving method, a data value of the data driver may be 0 or 1. Depending on whether a data of an organic light emitting diode OLED when it emits light is 0 or 1, a driving transistor Mb of the pixel circuit 113 may be NMOS or PMOS, and an actual voltage for data 1 may be a high voltage or a low voltage. Hence, in some embodiments, the organic light emitting display may increase or decrease a data voltage value so as to calibrate brightness.

The foregoing operations S1, S2, S3, and S4 may be repeated by the repeating operation S5 one or more times in order to perform real-time calibration of the organic light emitting display.

Through these operations S1 to S5, although brightness change may result from deterioration of the pixel circuit(s) or a change in an ambient temperature, it is possible to calibrate brightness appropriately. Embodiments of the invention may enable via, e.g., the aforementioned operations S1, S2, S3, S4, S5, to calibrate brightness in real-time, and/or to calibrate a data value.

Figure 8:
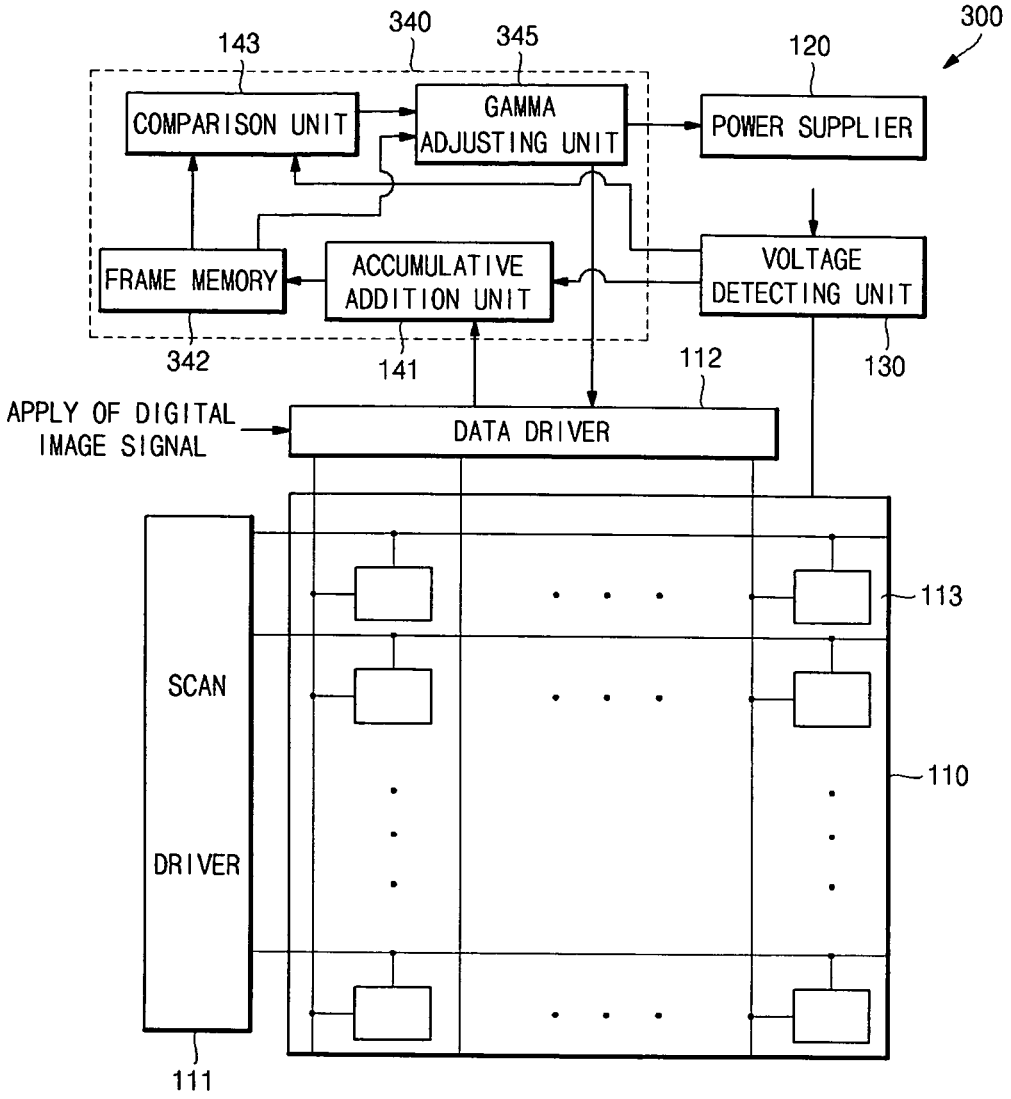
FIG. 8 illustrates a schematic block diagram of an organic light emitting display according to yet another exemplary embodiment of the present invention.
Figure 9A:
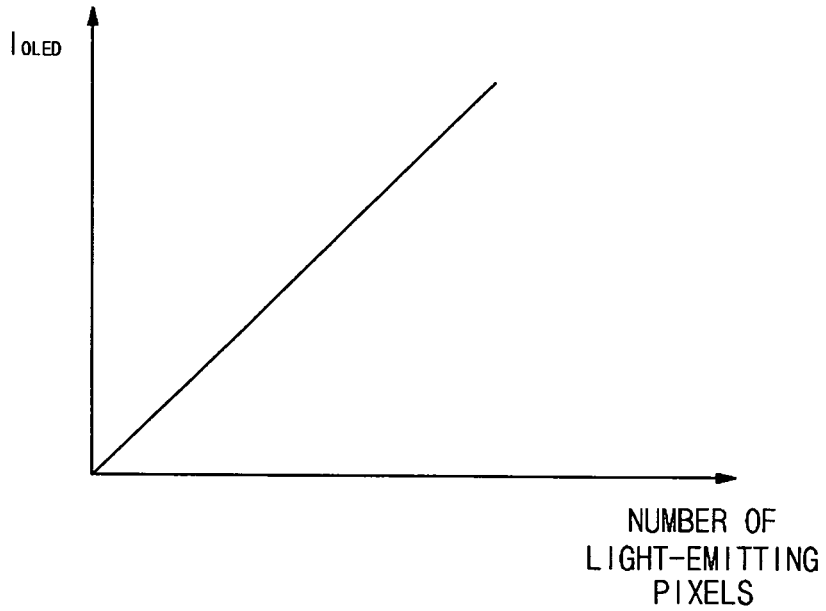
FIGS. 9A and 9B illustrate graphs of a pattern of a lookup table for calculating a reference value of a data value and a pattern of a lookup table for calibrating a data value in an organic light emitting display according to yet another exemplary embodiment of the present invention.
Figure 9B:
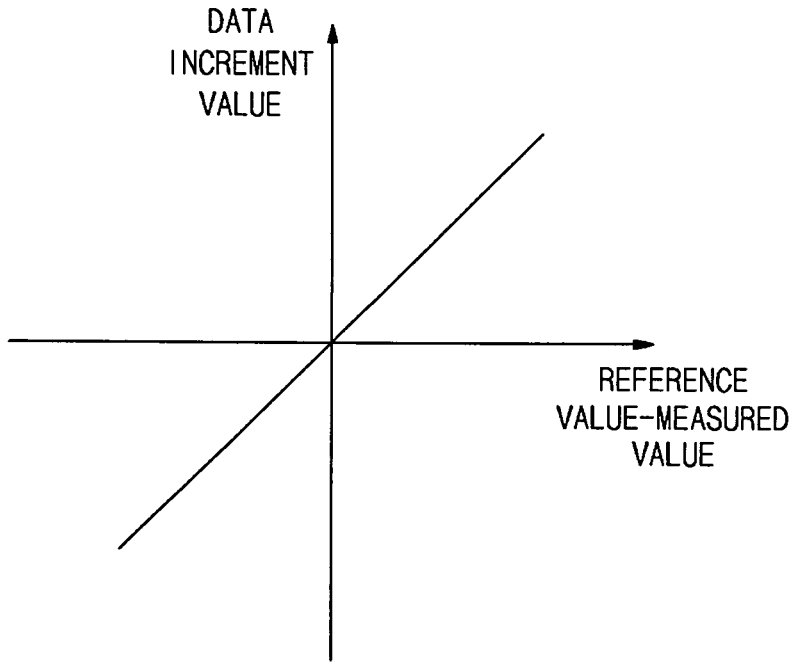

FIG. 8 illustrates a schematic block diagram of an organic light emitting display 300 according to yet another exemplary embodiment of the present invention. FIGS. 9A and 9B illustrate graphs of a pattern of a lookup table for calculating a reference value of a data value and a pattern of a lookup table for calibrating a data value in the organic light emitting display 300 according to yet another exemplary embodiment of the present invention.

As illustrated in FIG. 8, the organic light emitting display 300 according to yet another embodiment of the present invention may include, in addition to the organic light emitting display panel 110, the power supplier 120, the scan driver 111 and the voltage detecting unit 130, a controller 340 for controlling a data value applied to the organic light emitting display panel 110.

As illustrated in FIG. 8, the organic light emitting display 300 may substantially correspond to the organic light emitting display 100 of FIG. 2. Elements having the same constitutions and operations are denoted by the same reference numeral. In general, only differences between the organic light emitting display 300 and the organic light emitting display 100 of FIG. 1 will be described below.

Referring to FIG. 8, the controller 340 may be electrically coupled to the voltage detecting unit 130 and the data driver 112 of the organic light emitting display panel 110. The controller 340 may include the accumulative addition unit 141 that is electrically coupled to the voltage detecting unit 130, a frame memory 342 that is electrically coupled to the accumulative addition unit 141, the comparison unit 143 that is electrically coupled to the voltage detecting unit 130 and the frame memory 342, and a gamma adjusting unit 345 that is electrically coupled to the comparison unit 143.

The gamma adjusting unit 345 may be electrically coupled to the comparison unit 143. The gamma adjusting unit 345 may receive an output of the comparison unit 143. The gamma adjusting unit 345 may calibrate a data value of the data driver 112 of the organic light emitting display panel 110.

In the following description of the exemplary embodiments, it will be assumed that the driving transistor Mb of the pixel circuit 113 is PMOS and the organic light emitting diode OLED emits light when the data "1" is applied thereto. However, embodiments of the invention are not limited thereto.

Referring to FIG. 8, the gamma adjusting unit 345 may receive an output of the comparison unit 143 as an input. In some embodiments, when an output of the comparison unit is positive, i.e., a reference value of the frame memory 142 is larger than the measured voltage value of the voltage detecting unit 130, then the gamma adjusting unit 345 may carry out calibration for increasing brightness of the organic light emitting diode OLED. That is, e.g., in some embodiments, the organic light emitting display 300 may calibrate brightness thereof based on a data value of the data driver 112 thereof.

In the frame memory 342, a lookup table may be stored. The lookup table may calibrate a data value of the data driver 112.

FIGS. 9A and 9B illustrate graphs of a pattern of a lookup table for calculating a reference value of a data value and a pattern of a lookup table for calibrating a data value in an organic light emitting display according to yet another exemplary embodiment of the present invention.

More particularly, FIG. 9A illustrates a graph of a pattern of a lookup table that represents a reference value in accordance with an accumulative data value of the accumulative addition unit 141. In FIG. 9A, the pattern of the lookup table coincides with the pattern of the lookup table of FIG. 5.

FIG. 9B illustrates a graph of a pattern of a lookup table that represents a data increment value in accordance with an output of the comparison unit 143. A result of the comparison unit 143 may be a result produced by subtracting the measured value from the reference value. Referring to FIG. 9B, it may be possible to employ a lookup table representing a data increment value in accordance with a result of the comparison unit 143 using the pattern.

Depending on an output of the comparison unit 143, an output value of the gamma adjusting unit 345 may be determined. Referring to FIG. 9B, an output of the comparison unit 143 may be positive or negative. The gamma adjusting unit 345 may reduce a data value by as much as a result value corresponding to a lookup table employed. As discussed above, a driving transistor of the pixel circuit(s) 113 may be a PMOS, NMOS or CMOS, and may have a high voltage value or a low voltage value when a data value of the data driver 112 is "1." However, embodiments are not limited thereto.

A difference between the organic light emitting display 300 and the organic light emitting display 100 may include, depending on a result of the comparison unit 143, calibrating a data value of the data driver 112, rather than a voltage value of the power supplier 120. As a result, a lookup table representing a data increment value in accordance with an output of the comparison unit 143 of FIG. 9B may be further required. The lookup table may be stored in the frame memory 342.

Hereinafter, an organic light emitting display 400 according to yet another embodiment of the present invention will be described.

Figure 10:
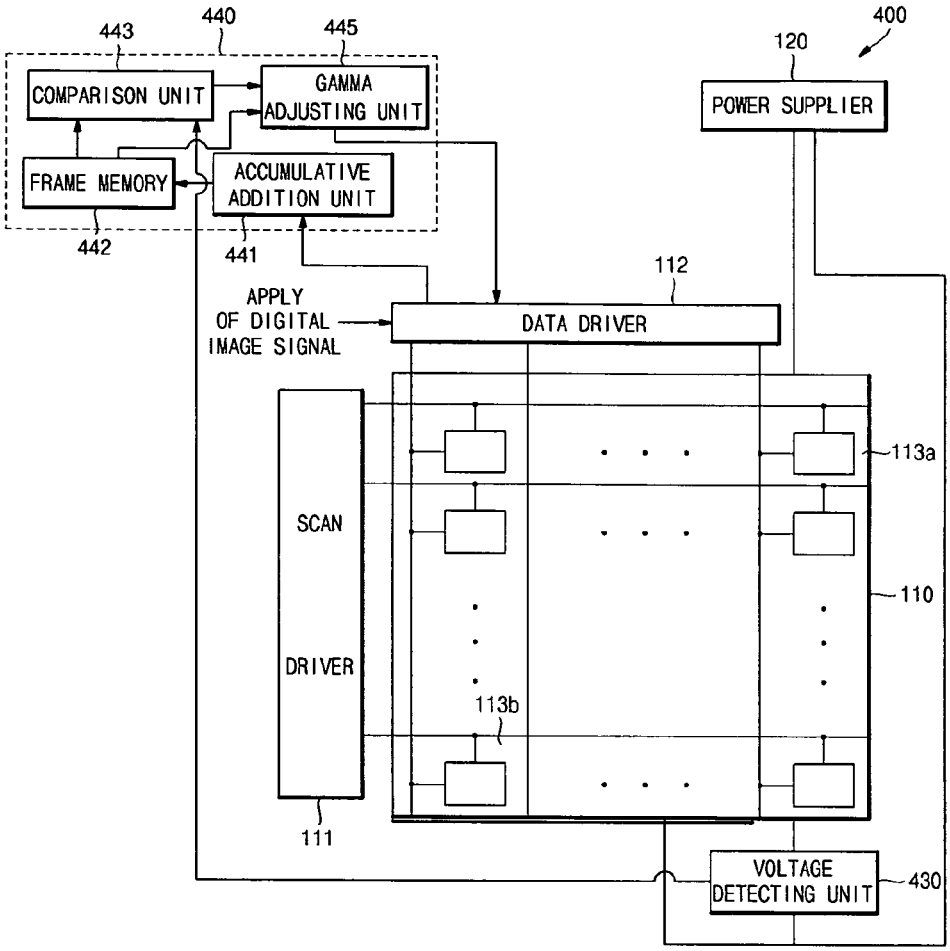
FIG. 10 illustrates a schematic block diagram of an organic light emitting display according to yet another exemplary embodiment of the present invention.

FIG. 10 illustrates a schematic block diagram of the organic light emitting display 400 according to yet another exemplary embodiment of the present invention As illustrated in FIG. 10, the organic light emitting display 400 may further include, in addition to the organic light emitting display panel 110 and the power supplier 120, a voltage detecting unit 430 that may measure a voltage applied to some pixel circuit(s) 113*a* of the organic light emitting display panel 110 and a controller 440 that may be electrically coupled to the voltage detecting unit 430.

As illustrated in FIG. 10, the organic light emitting display 400 may substantially correspond to the aforementioned organic light emitting displays 200 and 300. Elements having the same constitution and operation are denoted by the same reference numeral. Thus, in general, only differences between the exemplary display 400 and the exemplary displays 200, 300 will be described hereinafter.

As illustrated in FIG. 10, in some embodiments, the voltage detecting unit 430 may be electrically coupled between a portion of the organic light emitting display panel 110 and the power supplier 120. In some embodiments, the voltage detecting unit 230 may only be coupled to a portion (in FIG. 10, one column in the vertical direction) of the organic light emitting display panel 110. For example, the organic light emitting display panel 110 may include pixel circuit(s) 113*a* to which the voltage detecting unit 430 may be coupled and pixel circuit(s) 113*b* to which the voltage detecting unit 430 is not coupled. The pixel circuit(s) 113*a* and the pixel circuit(s) 113*b* may be coupled to the power supplier 120 through different wirings. The function of the voltage detecting unit 430 may be the same as that of the voltage detecting unit 230 of the exemplary display 200, and thus further description thereof may not be repeated.

The controller 440 may include an accumulative addition unit 441, a frame memory 442, a comparison unit 443 and a gamma adjusting unit 445.

In embodiments in which only a value of the partial pixel circuit(s) 113*a* is employed for measuring and comparing, then the accumulative addition unit 441 may receive only a data value applied to the pixel circuit(s) 113*a* to which the voltage detecting unit 430 is coupled from the data driver 112. More particularly, in some embodiments, differently from the aforementioned embodiment 300, the accumulative addition unit may not accumulate data from all pixel circuits of the display, but only partial data, i.e., only data corresponding to the pixel circuits 113*a*. Such embodiments may be advantageous because a speed of calculation may become faster.

The frame memory 442 may be electrically coupled to the accumulative addition unit 441. The frame memory 442 may receive an output of the accumulative addition unit 441 as an input and may determine a value of current flowing through a respective light-emitting pixel circuit, i.e., a reference value. Hence, a lookup table for calculating the reference value may be stored in the frame memory 442. The frame memory 442 may store a look up table for calculating a data calibration value in accordance with an output of the comparison unit 443. The lookup tables may be the same as the lookup table of the aforementioned embodiment 300 illustrated in FIGS. 9A and 9B. Since the frame memory 442 may be the same as the frame memory 342 in the aforementioned embodiment 300, further description thereof may not be repeated.

The comparison unit 443 may be electrically coupled to the voltage detecting unit 430 and the frame memory 442, and may receive their outputs as an input. The comparison unit 443 may serve to compare the measured value of the voltage detecting unit 430 with the calculated value of the frame memory 443. Except that the measured value and the calculated value, which may be comparative aspects of the comparison unit 443, may correspond to current values applied to the pixel circuit(s) 113*a* to which the voltage detecting unit is coupled, the comparison unit 430 may be the same as the comparison unit 143 of the aforementioned embodiment 300. Hence, further description thereof may not be repeated.

The gamma adjusting unit 445 may be electrically coupled to the frame memory 442 and the comparison unit 443. The gamma adjusting unit 445 may receive an output of the comparison unit 443 as an input and may receive a data calibration value from the lookup table stored in the frame memory 442. The gamma adjusting unit 445 may perform a function of calibrating a data value of the data driver 112 through the data calibration value. The gamma adjusting unit 445 may correspond to the gamma adjusting unit 345 of the aforementioned embodiment 300. Thus, further description thereabout will be omitted.

The organic light emitting display 400 according to yet another embodiment of the present invention may measure, differently from the exemplary display 300, only a voltage applied to the pixel circuit(s) 113*a* to which the voltage detecting unit 430 is coupled. The comparison unit 443 may compare a data value corresponding only to the pixel circuit(s) 113*a* to which the voltage detecting unit is coupled.

If only a value of the partial pixel circuit(s) 113*a* is used for measuring and comparing, then the accumulative addition unit 441 may not accumulate all data but only partial data. Such embodiments may be advantageous because a speed of calculation may be faster.

In some embodiments, a controller may be a combination of, e.g., the controllers 140 and 340, or, e.g., a combination of the controllers 240 and 440, so as to control a voltage of a power supplier and/or a data value.

According to the organic light emitting display of the present invention, a brightness change due to a deterioration of the organic light emitting diode OLED and/or a temperature change in real-time may be compensated by calibrating a power source voltage value.

According to the organic light emitting display of the present invention, a brightness change due to a deterioration of the organic light emitting diode OLED and/or a temperature change in real-time may be compensated by calibrating a data value.

According to the organic light emitting display of the present invention, a brightness change due to a deterioration of the organic light emitting diode OLED and/or a temperature change in real-time may be compensated by calibrating a power source voltage value and/or by calibrating a data value.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An organic light emitting display including a data driver, the organic light emitting display including an organic light emitting panel including a plurality of pixel circuits, the organic light emitting display comprising:

a power supplier electrically coupled to the organic light emitting display panel;

a voltage detector electrically coupled to the organic light emitting display panel, the voltage detector to detect a voltage of at least a portion of the organic light emitting panel; and a controller electrically coupled to the voltage detector, the controller to output a control signal to the power supplier based on the detected voltage, wherein the control signal is to adjust a power source voltage output from the power supplier so as to calibrate a brightness change in real-time in a pixel circuit currently emitting light, and wherein the controller includes:

an accumulative adder to accumulate data applied to a predetermined number of the pixel circuits, the accumulated data indicative of a number of pixels in the organic light emitting panel that emit light at a point in time;

a frame memory to store a reference value corresponding to the number of pixels indicated by the accumulated data, a comparator to compare the reference value with the voltage detected in the voltage detector; and a voltage adjuster to generate the control signal to adjust the power source voltage output from the power supplier based on a result of the comparator.

2. The organic light emitting display as claimed in claim 1, wherein the controller is to reduce a voltage value of the power supplier or decrease a brightness of the pixel circuits, or both, when the detected voltage value is larger than a voltage value calculated in the controller, and to increase a voltage value of the power supplier or increase the brightness of the pixel circuits, or both, when the detected voltage value is smaller than a voltage value calculated in the controller.

3. The organic light emitting display as claimed in claim 1, wherein the voltage detector is electrically coupled between the power supplier and the pixel circuits of the organic light emitting display panel.

4. The organic light emitting display as claimed in claim 1, wherein the voltage detector is coupled between the power supplier and all pixel circuits.

5. The organic light emitting display as claimed in claim 1, wherein the voltage detector is coupled between the power supplier and at least one pixel circuit.

6. The organic light emitting display as claimed in claim 1, wherein the voltage detector is coupled between the power supplier and the pixel circuits by a resistor and measures a voltage applied to the resistor.

7. The organic light emitting display as claimed in claim 1, wherein the accumulative adder is to accumulate data values applied to the predetermined number of pixel circuits for each of a plurality of periods of at least one frame.

8. The organic light emitting display as claimed in claim 1, wherein the frame memory stores a lookup table of the reference value for the accumulated data and transfers the reference value for the data to the comparator.

9. The organic light emitting display as claimed in claim 1, wherein the frame memory is a PROM, an EPROM, an EEPROM, or a flash memory.

10. The organic light emitting display as claimed in claim 1, wherein the comparator transfers a difference between the reference value and the voltage detected to the voltage adjuster.

11. The organic light emitting display as claimed in claim 10, wherein the voltage adjuster increases a voltage of the power supplier based on a difference between the reference value and the voltage detected.

12. The organic light emitting display as claimed in claim 1, wherein the voltage detector is coupled between the power supplier and the predetermined number of pixel circuits, the predetermined number corresponding to less than all of the pixel circuits.

13. A driving method of an organic light emitting display including a data driver, the organic light emitting display including an organic light emitting panel including a plurality of pixel circuits, the method comprising:

supplying power to the organic light emitting display panel by a power supplier;

detecting a voltage of at least a portion of the organic light emitting panel by a voltage detector; and controlling the power supplier based on the detected voltage value by a controller, the controlling including adjusting a power source voltage output from the power supplier so as to calibrate a brightness change in real-time in a pixel circuit currently emitting light, the controller being electrically coupled to the voltage detector, wherein controlling the power supplier includes:

accumulating data applied to a predetermined number of the pixel circuits, the accumulated data indicative of a number of pixels in the organic light emitting panel that emit light at a point in time;

receiving a reference value corresponding to the number of pixels indicated by the accumulated data, comparing the reference value with the detected voltage and adjusting the power source voltage output from the power supplier based on a result of the comparator.

14. The driving method as claimed in claim 13, wherein controlling comprises decreasing a voltage value of the power supplier when a voltage value detected in the voltage detector is larger than a voltage value calculated in the controller and increasing a voltage value of the power supplier when a voltage value detected in the voltage detector is smaller than a voltage value calculated in the controller.

15. The driving method as claimed in claim 13, wherein controlling comprises outputting a control signal for decreasing a brightness of the pixel circuits when a voltage value detected in the voltage detector is larger than a voltage value calculated in the controller and outputting a control signal for increasing a brightness of the pixel circuits when a voltage value detected in the voltage detector is smaller than a voltage value calculated in the controller.

16. The driving method as claimed in claim 13, wherein the voltage detector is electrically coupled between the power supplier and the pixel circuits of the organic light emitting display panel.

17. The driving method as claimed in claim 13, wherein the voltage detector is coupled to the power supplier and all pixel circuits of the organic light emitting display and detecting comprises detecting a voltage of all the pixel circuits.

18. The driving method as claimed in claim 13, wherein the voltage detector is coupled between the power supplier and at least one pixel circuit.

19. The driving method as claimed in claim 13, wherein the voltage detector is coupled between the power supplier and only some of the pixel circuits.

20. The driving method as claimed in claim 13, wherein the voltage detector is coupled between the power supplier and the pixel circuits by a resistor and measures a voltage applied to the resistor.

* * * * *